US005931146A

United States Patent [19]

Schrader et al.

[11] Patent Number: 5,931,146

[45] Date of Patent: Aug. 3, 1999

[54] BOW TENSION RELIEVING DEVICE

[76] Inventors: Steven E. Schrader, 8083 Russell Rd.; Steven R. Zak, 6346 15th St., both of Twin Lakes, Mich. 49457

[21] Appl. No.: 09/007,727

[22] Filed: Jan. 15, 1998

Related U.S. Application Data

[60] Provisional application No. 60/036,259, Jan. 18, 1997.

[51] Int. Cl.[6] ..... F41B 5/00

[52] U.S. Cl. ..... 124/23.1; 124/86

[58] Field of Search ..... 124/23.1, 25.6, 124/25, 86, 88

[56] References Cited

U.S. PATENT DOCUMENTS

| | | | |
|---|---|---|---|
| 3,913,556 | 10/1975 | Palma | 124/23.1 X |
| 4,478,202 | 10/1984 | Anderson | 124/23.1 |
| 5,205,269 | 4/1993 | Guzzetta | 124/25.6 |
| 5,222,473 | 6/1993 | Lint | 124/86 |
| 5,445,139 | 8/1995 | Bybee | 124/23.1 |

*Primary Examiner*—John A. Ricci

[57] ABSTRACT

A bow tension relieving device that is useful with a bow that has a riser with opposing riser ends, has a first limb connected with a first riser end and extending in a direction that is generally away from a second riser end, and has a second limb connected with the second riser end and extending in a direction that is generally away from the first riser end. Each of the limbs also has an inner limb end at the riser. The bow tension relieving device has a coupling interconnecting the riser and one of the limbs. The coupling is actuatable between first and second positions to rotate the one limb a predetermined amount in a first rotational direction to decrease an effort of drawing the bow to a shooting position in the first position, and to rotate the one limb a predetermined amount in a second, opposing, rotational direction to increase the shooting force to a predetermined maximum level in the second position. The bow tension relieving device also has an actuator operatively connected with the coupler to actuate the coupler between the first and second positions. The actuator has a bias device that is operatively connected with the coupling and has a trigger that is operatively connected with the bias device. The bias device has a charged state and a released state, and is releasable from the charged state to the released state. The coupler is actuated from the first position to the second position when the bias device is released from the charged state to the released state. Further, the trigger is settable by a user to hold the bias device in the charged state and is controllable by a user to release the bias device to the released state.

20 Claims, 13 Drawing Sheets

Fig. 2A
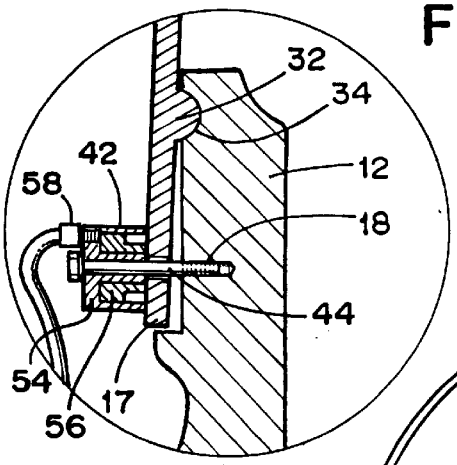
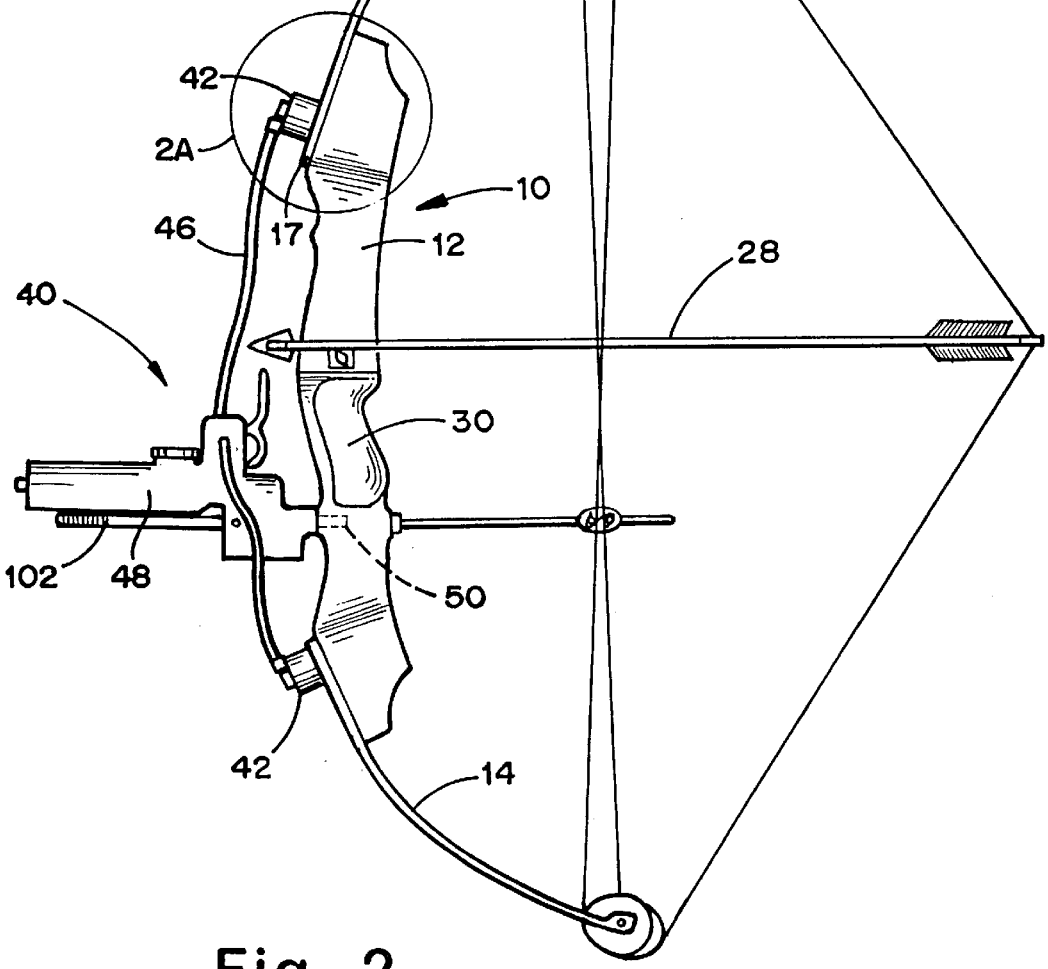
Fig. 2

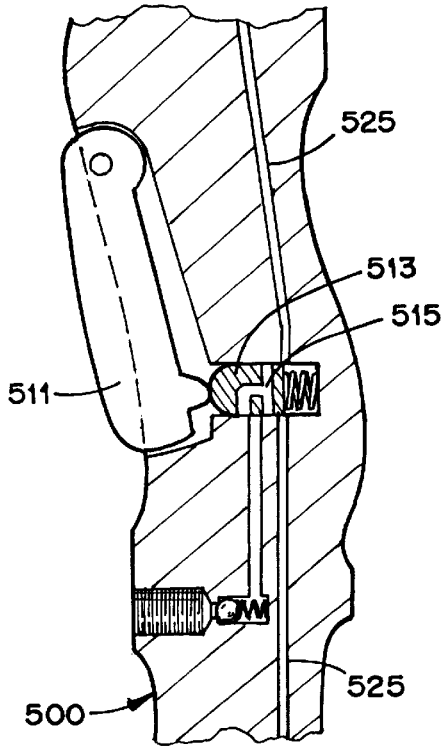
Fig. 10D
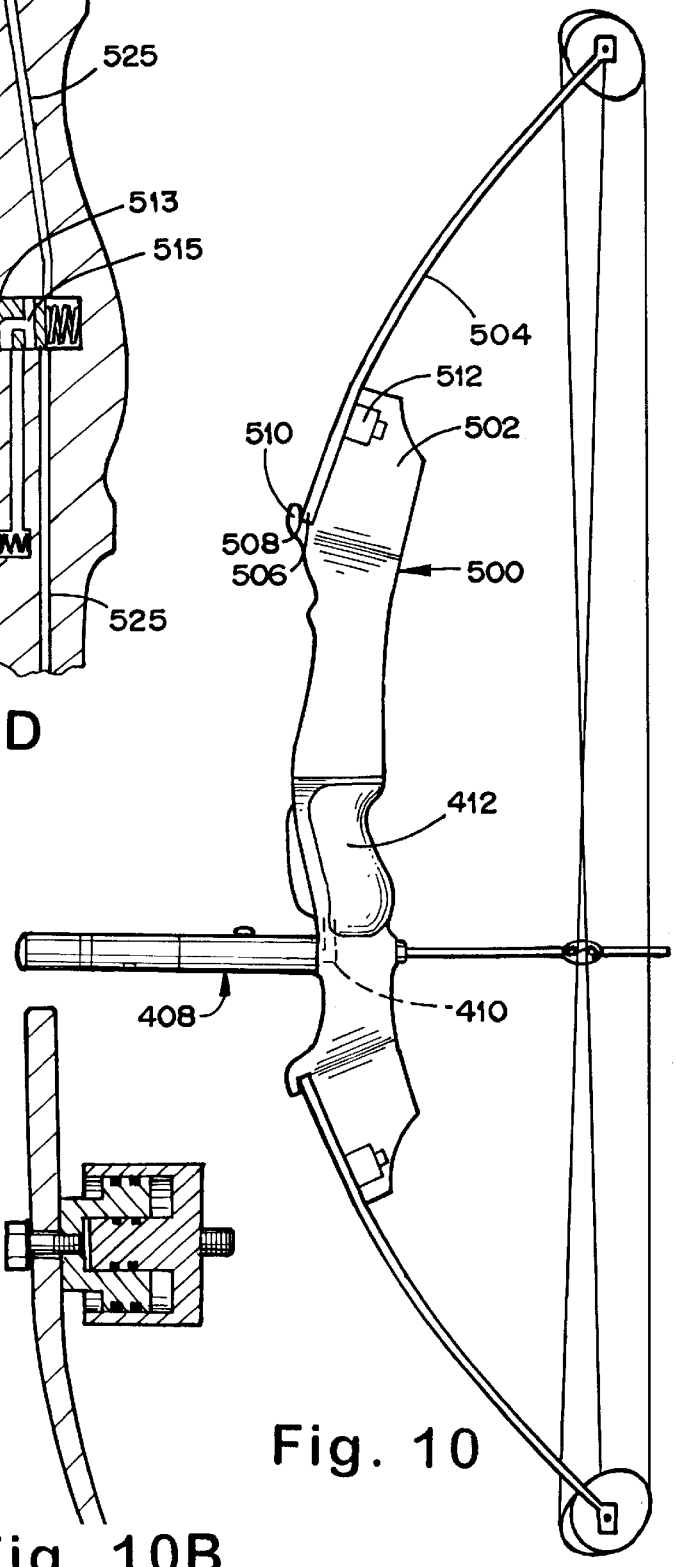
Fig. 10
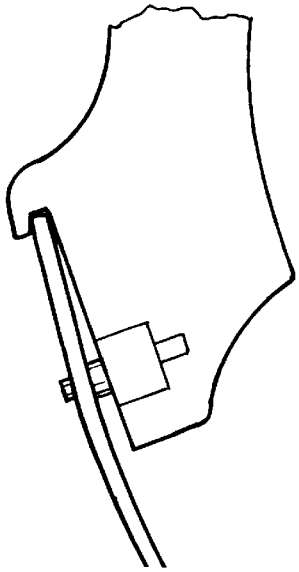
Fig. 10C
Fig. 10B

BOW TENSION RELIEVING DEVICE

CROSS-REFERENCES TO RELATED APPLICATIONS

This is a continuing application of co-pending U.S. patent application Ser. No. 60/036,259, entitled BOW TENSION RELIEVING DEVICE and filed on Jan. 18, 1997 by Steven E. Schrader and Steven R. Zak, the disclosure of which is incorporated here by reference.

STATEMENT REGARDING FEDERALLY SPONSORED RESEARCH OR DEVELOPMENT

Not Applicable.

BACKGROUND OF THE INVENTION

The invention relates to a bow tensioning device and more particularly a device that reduces the draw weight of the bow while the bow is being drawn, and permits full thrust after the bow is drawn.

Archery bows and particularly compound bows can be difficult to draw. A compound bow typically has a high initial draw weight and the draw weight is reduced or let-off when the bow is fully drawn. As an example, a compound bow may have an initial draw weight of eighty pounds but may have a fifty percent (50%) let-off at full draw, which reduces the holding force of the drawn bow to about forty pounds.

The high initial draw weight makes it difficult for some archers to draw a compound bow. Also, once the bow is drawn, the force of the bow makes it difficult to relieve the tension on the bow without taking a shot.

A typical compound bow comprises a pair of flexible limbs mounted on opposite sides of a riser positioned between the limbs. The riser serves as the handle of the bow. Each limb is bolted to the riser by a single bolt. The bolts can be tightened or loosened in order to "tune" the compound bow and adjust the tension and draw weight of the bow. A prior art bow construction is shown in FIG. 1. In such a bow, when the bolts are loosened, there is less spring force on the limbs when the bow string is drawn, thus reducing bow tension. This, however, produces a corresponding reduction in bow thrust during operation and thus reduces the performance of the bow. When the bolts are tightened, bow tension increases to its maximum level.

BRIEF SUMMARY OF THE INVENTION

Accordingly, the invention provides a compound bow in which the limbs of the bow are clamped to the riser with an adjustable force that can be applied or released after the bow string has been drawn. This provides a low draw weight when the bow is drawn and full thrust when the arrow is shot. In other words, the invention provides an adjustable draw weight in a compound bow by clamping flexible bow limbs to a riser with an adjustable clamping mechanism that reduces the draw weight of the bow when the bow is being drawn and may be actuated after the bow is drawn to provide full thrust when an arrow is shot.

In one embodiment of the invention, the clamp comprises a pair of slave cylinders that are substituted for or mounted on the bolts that attach the limbs to the riser of a compound bow. A fluid driven power cylinder attached to the riser drives the slave cylinders. The power cylinder can be pressurized by a hand pump attached to the cylinder or by a pre-charged pressurized air cylinder. The slave cylinder has a normally released position wherein the limbs are loosely mounted on the riser, so the bow can be drawn easily. A trigger mechanism accessible by the hand of the operator permits pressurization of the clamping mechanism to clamp the limbs tightly against the riser, and increase the bow force after the bow is drawn. A release mechanism permits release of the pressure on the risers in the event it is necessary to release the bow string without firing an arrow.

In another embodiment of the invention, the clamping mechanism for the limbs is a mechanical cam actuated device instead of a hydraulic or fluid operated device.

In one aspect of the invention, the invention is incorporated in a kit for retrofitting an existing compound bow. In another aspect of the invention, the invention is incorporated into the compound bow as original equipment, with the slave cylinders being imbedded in the riser.

In another aspect of the invention, the mechanism is employed to provide a lower draw weight for a cross bow.

With the use of the present invention in a typical compound bow, the initial draw weight of the compound bow can be reduced from 80 pounds to 30 pounds or less and the initial low draw weight can be maintained for the drawn bow until a decision to shoot has been rendered, in which case the trigger is pulled and the bow is returned to its full force.

These and other features, objects, and benefits of the invention will be recognized by one having ordinary skill in the art and by those who practice the invention, from the specification, the claims, and the drawing figures.

BRIEF DESCRIPTION OF THE SEVERAL VIEWS OF THE DRAWING

FIG. 2 is a plan view of a bow of the type shown in FIG. 1 that has been retrofitted with a variable bow tensioning device of the present invention.

FIG. 2*a* is a fragmentary cross-sectional view showing the manner in which a slave cylinder is employed to attach a limb to the riser with a variable clamping force, the limbs of the bow being shown in a relaxed position in FIGS. 2 and 2*a*.

FIG. 10 is a plan view of another embodiment of the present invention employing a manually actuateable pump of the type shown in FIG. 9 with a different type of action.

FIG. 10*b* is a cross-sectional view of the slave cylinder of FIG. 10.

FIG. 10*c* is a cross-sectional view of the slave cylinder of FIG. 10, shown in its extended position, as in FIG. 10*b*.

FIG. 10*d* is a cross-sectional view of the trigger mechanism of FIG. 10.

DETAILED DESCRIPTION OF THE INVENTION

Figures 1, 1A:
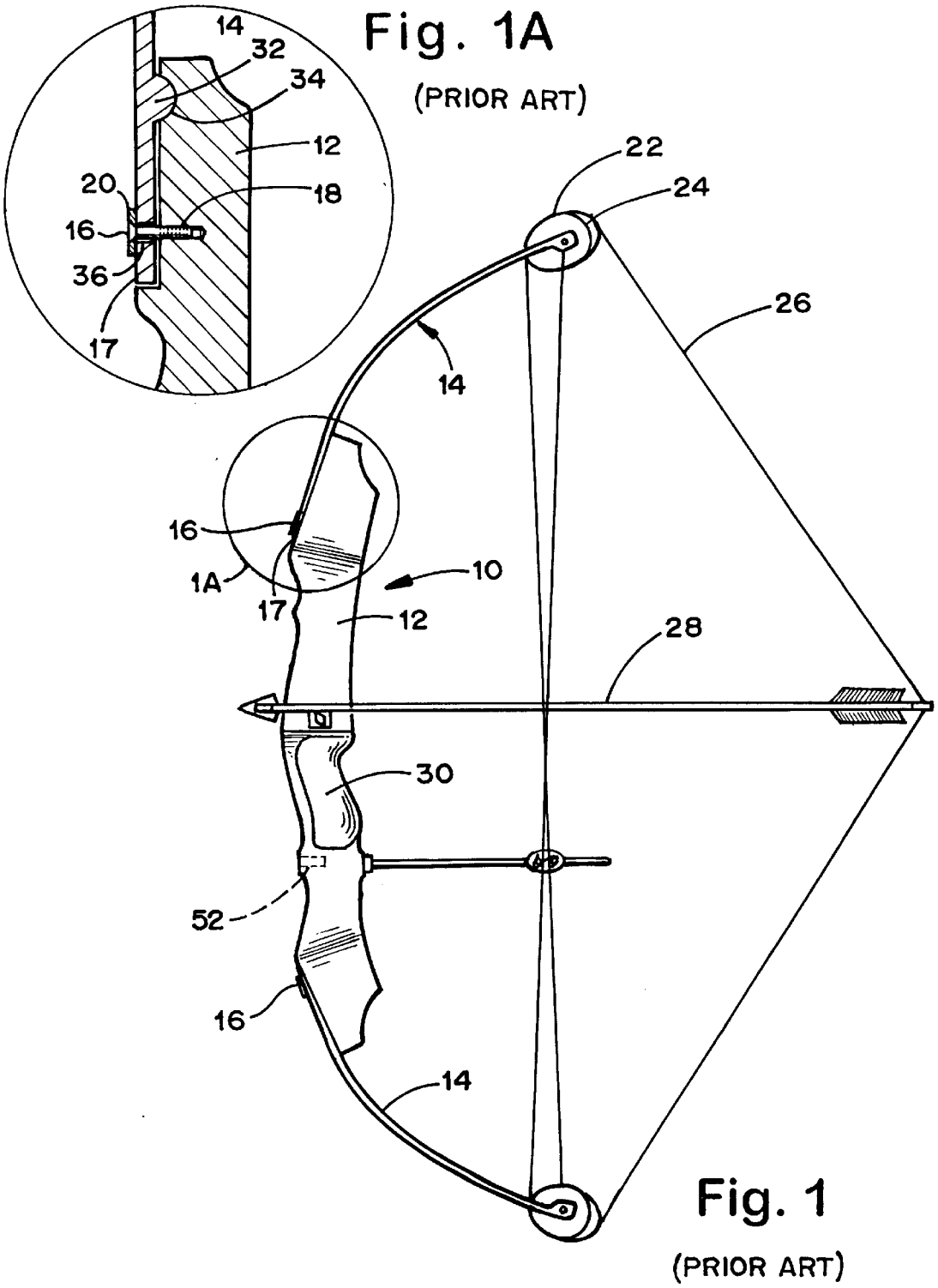
Fig. 1A (PRIOR ART)
Fig. 1 (PRIOR ART)
FIG. 1 is a plan view of a compound bow constructed in accordance with the prior art.
FIG. 1*a* is a fragmentary cross-sectional view of the prior art bow of FIG. 1, showing the manner in which a limb is bolted to a riser.

Referring to the drawings, a conventional compound bow 10 is shown in FIG. 1. Compound bow 10 includes a riser 12 and flexible limbs 14 mounted on upper and lower ends of the riser. An inner end 17 of each limb is bolted to the riser by a bolt 16 which is received in a threaded opening 18 in the riser. A washer 20 is disposed between the head of the fastener and the limb. The outer end 22 of each limb is connected to a pulley mechanism 24 for the compound bow, and a bow string 26 extends between the outer ends of the limbs in a conventional fashion. An arrow 28 is shown in FIG. 1, with the bow being shown in a drawn position. The bow is held by means of hand grip 30 on riser 12.

Referring to FIG. 1*a,* limb 14 has a rounded protrusion 32 in a mating, rounded socket 34 in the riser so that the limb can pivot about protrusion 32. Further toward the inner end 17 of limb 14, bolt 16 extends through an opening 36 in the limb. When the bow is strung and tension is applied to the limbs in the manner shown in FIG. 1, the limb tends to rock around protrusion 32 and urge end 17 of the limb outwardly away from the riser. Fastener 16 holds the limb in place. Fastener 16 can be tightened snugly against the riser to maintain maximum spring in the limb; or the bolt can be loosened to provide a range of pivotal movement of the limb before the limb begins to deflect. These bolts are intentionally designed in most applications to be adjustable in order to provide the desired pull on the bow string.

When a person desires to have a lighter draw weight on the bow, the person would loosen bolt 16 and relax the connection between the limb and the riser. This, unfortunately, has the side effect of lowering the power of the bow when the arrow is released. For maximum power in the bow, the bolt 16 is tightened down snugly against riser 12, in the manner shown in FIG. 1*a.* This has the side effect of making the bow harder to draw initially.

In FIG. 2, compound bow 10 has been modified with a tension relieving device 40 constructed in accordance with the present invention. Tension relieving device 40 comprises a pair of slave cylinders 42 that are substituted for the fastener used to hold the limbs to the riser in FIG. 1. Slave cylinders 42 may be mounted on the outer side of each limb 14 and may be fastened to the riser by elongated bolts 44 that engage the same openings 18 in the riser that were employed for conventional fastener 16. The bolts 44 are longer than fastener 16 to accommodate the thickness of the slave cylinders 42. The slave cylinders 42 may be connected by hydraulic conduits 46 to a hydraulic pump 48, which may be mounted by a threaded fastener 50 that engages a conventional stabilizer mounting hole 52 (see FIG. 1), below the hand grip 30 of the riser.

The slave cylinders 42 may be actuated by hydraulic pressure to clamp and release inner end 17 of each limb to the riser 12. Each slave cylinder 42 preferably has a casing 54 that is loosely attached to the riser 12 by a bolt 44 to leave a space between the slave cylinder and the riser to permit limb 14 to pivot outwardly away from the riser a predetermined amount. Each slave cylinder 42 has an axially slidable piston or slide 56 mounted in the housing 54 and having an outer end 70 that bears against the limb 14. When tension relieving device 40 is actuated to inject fluid into the housing 54, through opening 58, pressure moves piston 56 to slide outwardly from the housing to pivot end 17 of limb 14 into a firmly engaged position against riser 12. In this position, the limb has its maximum spring strength.

Figure 5:
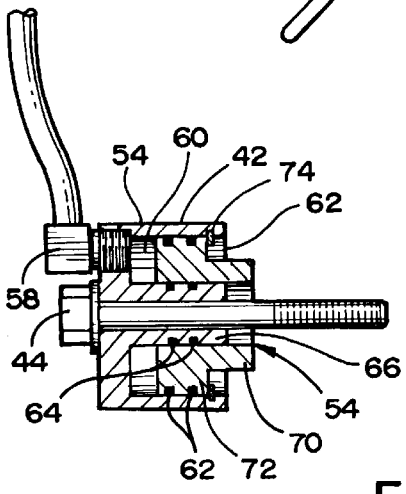
FIG. 5 is a cross-sectional view of the slave cylinder of FIGS. 2–4.

The position of the limb 14 when the slave cylinder 42 is unactuated and the limb is relaxed is shown in FIG. 2*a,* wherein the end 17 of the limb is pivoted or spaced away from the riser 12. The slave cylinder 42 is shown in an actuated position in FIG. 3*a,* wherein the end of the limb 17 is clamped tightly against the riser 12. A construction of the slave cylinder 42 is shown generally in FIGS. 2*a* and 3*a,* and is shown in more detail in FIG. 5. The outer casing 54 of cylinder 42 may have an annular recess 60 with an open end 62 that faces the riser 12 and limb 14. The fluid line fitting 58 provides an inlet to recess 60. Piston 56 may be provided with an annular seal 62 around its outer perimeter to seal the piston with the casing 54. The casing 54 may have seals 64 on an inner portion 66 of the casing to seal between the inside surface of the piston 56 and the inner portion or core 66 of the casing. Core 66 has an aperture extending therethrough that accommodates bolt 44, which is longer than the standard bolt. Piston 54 may have an outer end 70 of reduced diameter that protrudes out of the open end 62 of the cylinder and bears against the limb of the bow. An enlarged portion 72 of the piston is limited in its outward movement by a ring retainer 74 adjacent the open ends 62 of the casing. When the tension relieving device 40 is in an unactuated mode, the slave cylinder 42 is also unactuated and the actuating fluid is free to flow out of the cylinder. With the bow in a strung condition, there will be some magnitude of force exerted against the piston 56 by the inner end 17 of the limb 14, as will be understood by one having ordinary skill in the art. Thus, the piston may be made to reciprocate between a unactuated position as shown in FIG. 2*a* and an actuated position as shown in FIG. 5, wherein the outer end 70 of the piston protrudes outwardly from the end of the casing.

Figures 3, 3A:
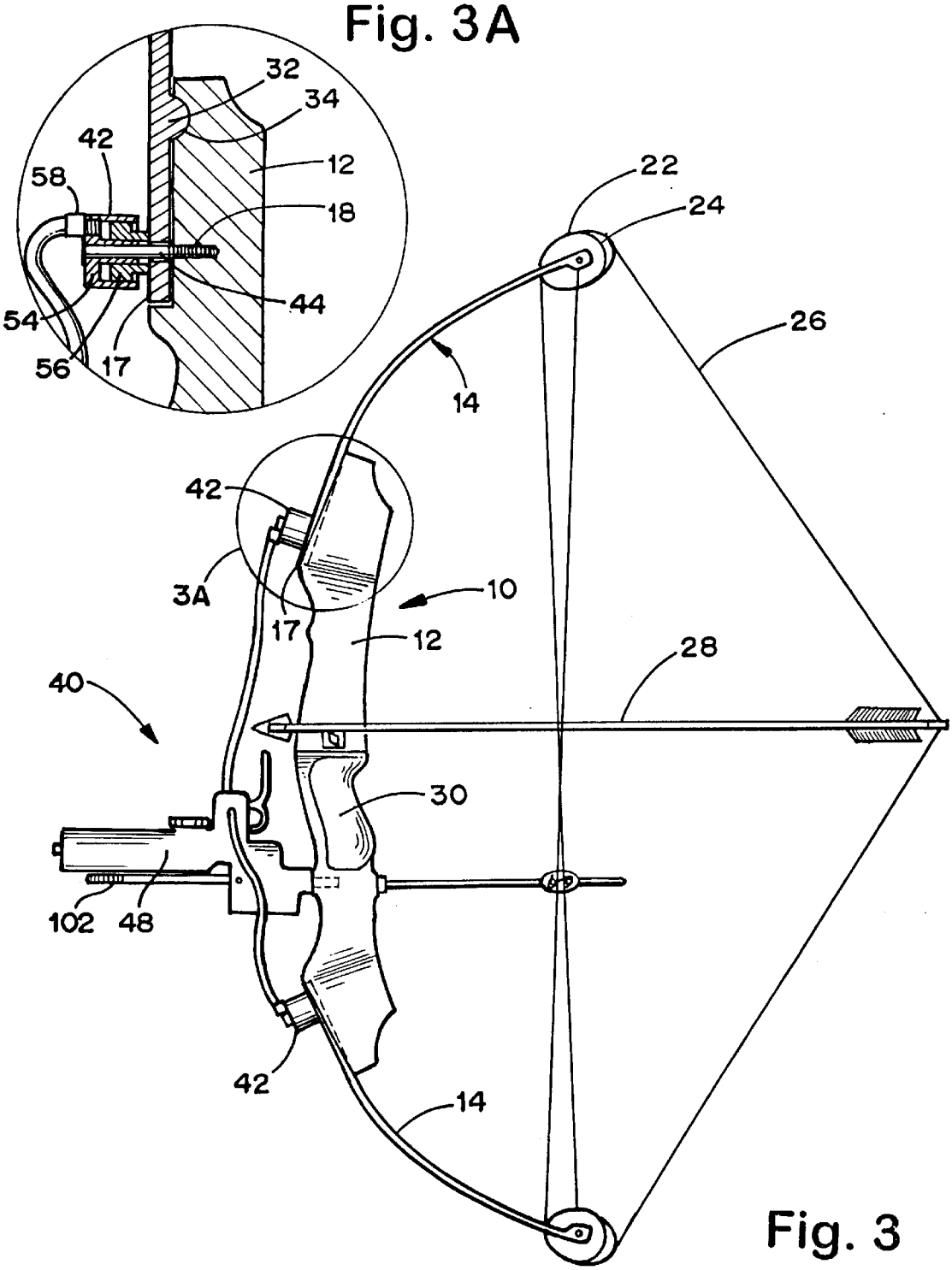
FIG. 3 is a plan view of the bow shown in FIG. 2, with the bow being drawn and the clamping mechanism having been actuated to restore full thrust to the bow.
FIG. 3*a* is a fragmentary cross-sectional view of the bow of FIG. 3, showing the clamping mechanism in its actuated condition, clamping the limb tightly to the riser.
Figure 4:
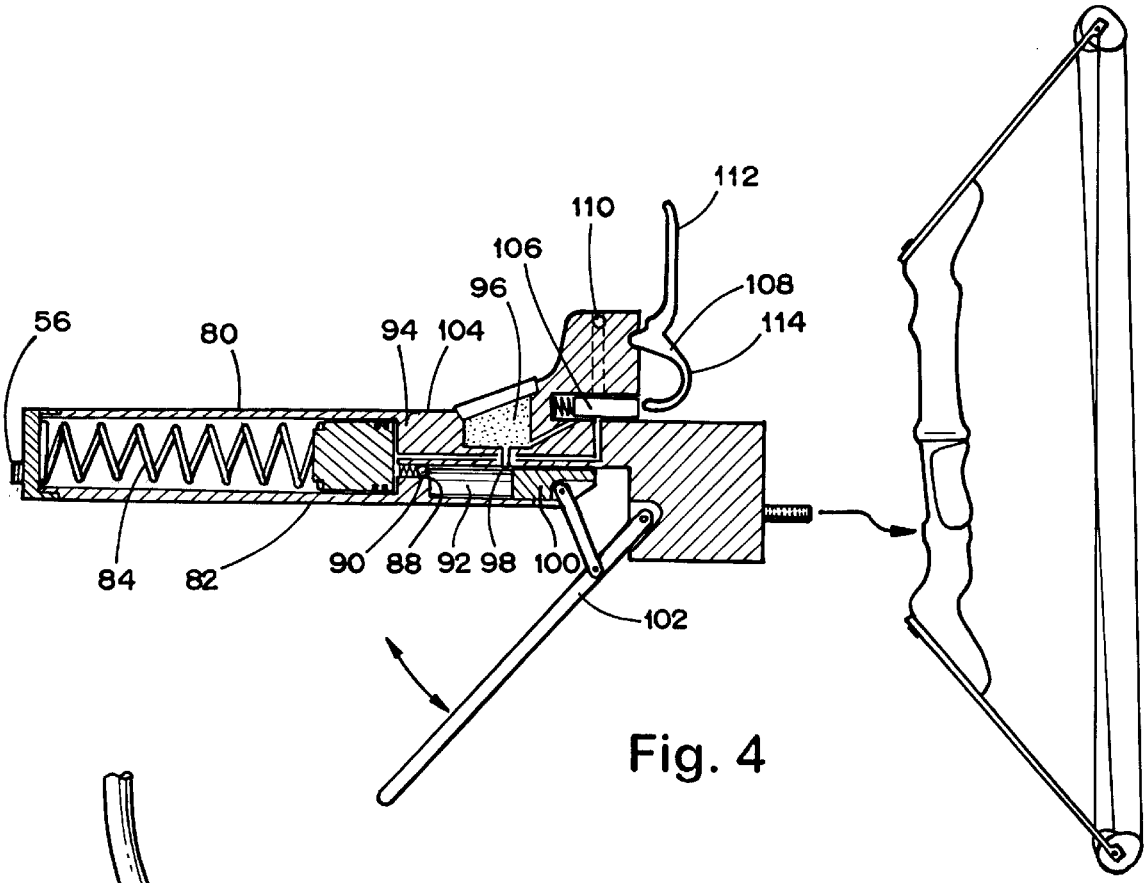
FIG. 4 is a schematic sectional view showing the internal construction of the master cylinder of the embodiments of FIGS. 2 and 3.

The actuating mechanism 40 shown in FIGS. 1–4 comprises a hydraulic pump 48. Pump 48 comprises (FIG. 4) a cylinder 80 with a movable piston 82 mounted therein and biased to the right (FIG. 4 orientation) by air pressure and a spring 84. Air is introduced to the cylinder by a schrader valve 86. Cylinder 80 includes a hydraulic fluid inlet 88 that includes a check valve 90 permitting fluid to flow from a chamber 92 in a one way direction into a piston chamber 94. Fluid is pumped into the chamber from a fluid reservoir 96 through a conduit 98 into fluid chamber 92. There a piston 100 actuated by a hand operated lever mechanism 102 that causes the piston to reciprocate in the fluid chamber 92, forcing fluid from chamber 92 through the check valve 90 and into the piston chamber 94, which in turn moves the piston 82 to the left (as shown in FIG. 4).

An outlet fluid conduit 104 communicates from the piston chamber 94 to a shut-off valve 106 that is operated by a trigger mechanism 108. The shut-off valve 106 communicates by conduits 110 to the slave cylinders 42. The trigger 108 has a first arm 114 that is positioned near a grasping portion of the hand grip or riser 12 so that it may be pulled with a finger of the operator while he holds the bow at the grasping portion, either in a ready to fire or a released position. By pulling arm 114, shut-off valve 106 is actuated in a first direction and pressurized fluid is released from the slave cylinders 42 to release the limbs 14 to a released or relaxed condition, in which a minimal draw effort is required to draw the bow to a shooting position.

The trigger 108 also has a second arm 112 that is positioned adjacent the grasping portion of the hand grip or riser 12 so that it is conveniently pulled with a finger of the operator while the bow is held at the grasping portion, in the shooting position. By pulling arm 112, shut-off valve 106 is actuated in a second direction, opposite to the first direction, and pressurized fluid is released from the piston chamber 94. The pressurized fluid is introduced into the slave cylinders 42, through the conduits 46, to clamp the limbs to the riser tightly and provide the full thrust force of the bow.

Thus, arm 114 of the trigger 108 may first be pulled so the bow may be drawn for shooting in a released or relaxed condition, in which a minimal draw effort is required. Once drawn in the shooting position, the arm 112 of the trigger 108 may be pulled to activate the clamping mechanism and restore full thrust force of the bow for shooting.

It should be noted that while air pressure may be used as a pressure source, hydraulic fluid is most preferably used to pressurize the slave cylinders. Moreover, the hydraulic fluid is most preferably conveyed to the slave cylinders by conduits 46 that are constructed of metal. Thus, a non-compressible fluid in a non-expandable conduit prevents loss of clamping power by compression of the fluid or expansion of the conduit. This, then, enhances the positive clamping force of the slave cylinder, all as one having ordinary skill in the art will understand.

With the apparatus described, the pumping lever 102 is stored in a horizontal or upward position as shown in FIG. 2 and is pivoted to a deployed or downward position as shown in FIG. 4. Reciprocating the pump lever 102 between upward and downward directions moves, or pumps, fluid from the reservoir 96 to the piston chamber 94, and charges the piston chamber 94 with pressurized hydraulic fluid. One having ordinary skill in the art will understand that the spring 84 and the pressurized air in cylinder 80 resists pumping of fluid into chamber 94. Thus, pumping fluid into chamber 94 will not only increase the volume of fluid in the chamber, it will also displace the piston 82 against the spring 84 and the air contained in cylinder 80 to increase the pressure in the cylinder. The resulting pressure that is "pumped up" into cylinder 80, and its contents, is held until the trigger 108 is pulled.

Figure 6:
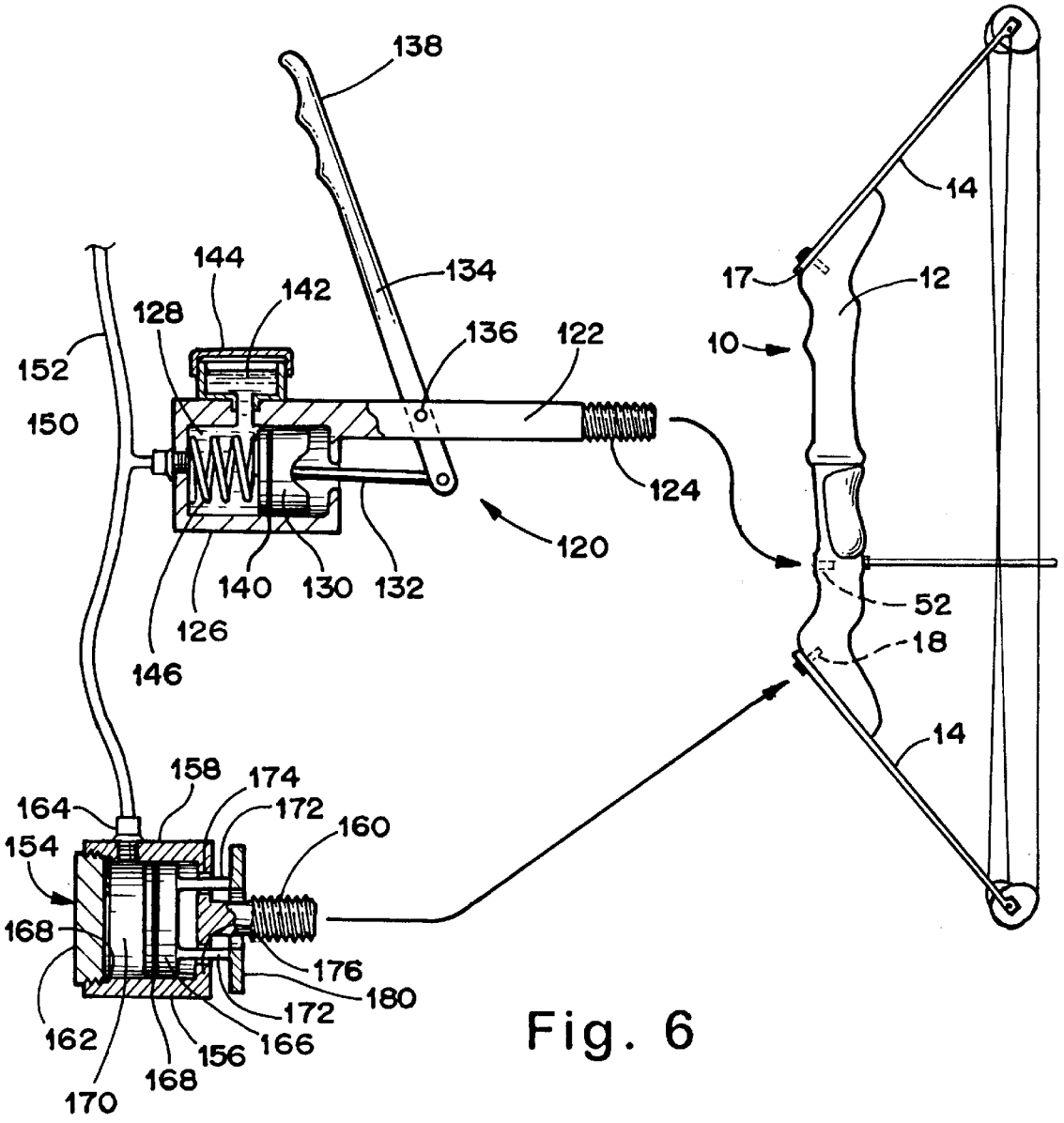
FIG. 6 is a schematic view showing a cross-sectional view of an alternative construction of a master cylinder and slave cylinder mechanism of the present invention.

The second embodiment of the present invention is shown in FIG. 6. In this embodiment, a pump 120 comprises a base 122 with a threaded end 124 that screws into the stabilizer fitting 52 in the riser 12 of bow 10 (which is the same as the bow in FIGS. 1–5). Body 122 includes a cylinder 126 having an open cavity 128. A piston 130 reciprocates in the cylinder and is connected by a push rod 132 to a pivoting arm 134 pivotally mounted by pin 136 to body 122. A finger engaging portion 138 can be pulled toward the bow operator in order to reciprocate the piston in the cylinder. The piston has seals 140 preventing liquid from leaking around the sides of the piston. A fluid chamber 142 covered by a cap 144 provides fluid for the chamber in the cylinder. A spring 146 biases the piston toward a retracted position. The cylinder has an outlet 150 which leads to hydraulic lines or conduits 152 which in turn are connected to slave cylinders 154. As before, it is preferred that the hydraulic lines be metal.

Slave cylinders 154 (only one is shown) comprise a body 156 having an open ended cylinder 158 at one end and a threaded shaft 160 at the other end. A cap 162 threads into an open end of the cylinder. A fluid line fitting 164 is provided in the sidewall of the cylinder. A piston 166 having seals 168 around its periphery is mounted for reciprocal movement in a piston chamber 170 in the cylinder. The piston has legs 172 that extend through openings 174 in end 176 of the cylinder. Washer type feet 180 extend outwardly from the ends of the legs.

In operation, the threaded shaft 160 threads into the bow riser bolt openings 18, replacing the bolts in the original equipment. Washer type feet 180 bear against the limbs 14 of the bow. When the slave cylinder is unactuated, the piston is positioned to the left (FIG. 6 orientation), and this permits the end 17 of the limb to pivot away from the riser in the manner shown in FIG. 2*a*. When lever 134 is actuated by pulling on finger grips 138, pressurized hydraulic fluid actuates the slave cylinders and moves piston 166 to the right (FIG. 6 orientation). This clamps the end of the limb against the end of the riser in the manner shown in FIG. 3*a*. The pressure on the fluid can be released simply by releasing the finger grips. Spring 146 then urges piston 130 to its retracted position and releases the pressure on the fluid.

To operate the device of FIG. 6, the bow string is drawn with the fingers released from lever 134. After the bow string is drawn and the operator wishes to set the bow for maximum thrust, the operator reaches out the fingers of the hand holding the handle of the bow and pulls the finger grip toward him. This pressurizes the fluid and actuates the slave cylinders to press the ends of the limbs firmly against the riser, providing maximum spring tension in the limbs.

Figure 7B:
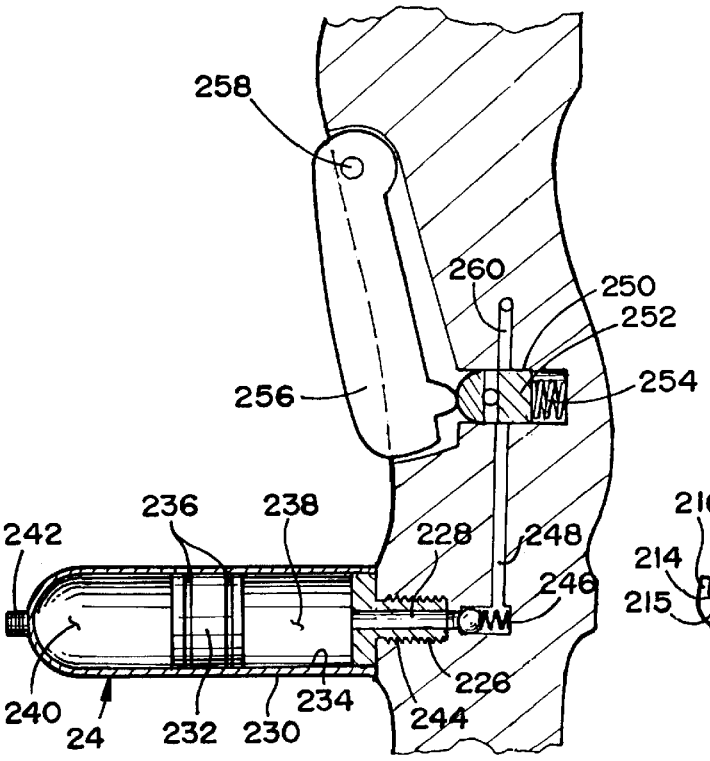
FIG. 7*b* is an exploded sectional view showing the drive cylinder and actuation mechanism of the embodiment of FIG. 7.
Figure 7:
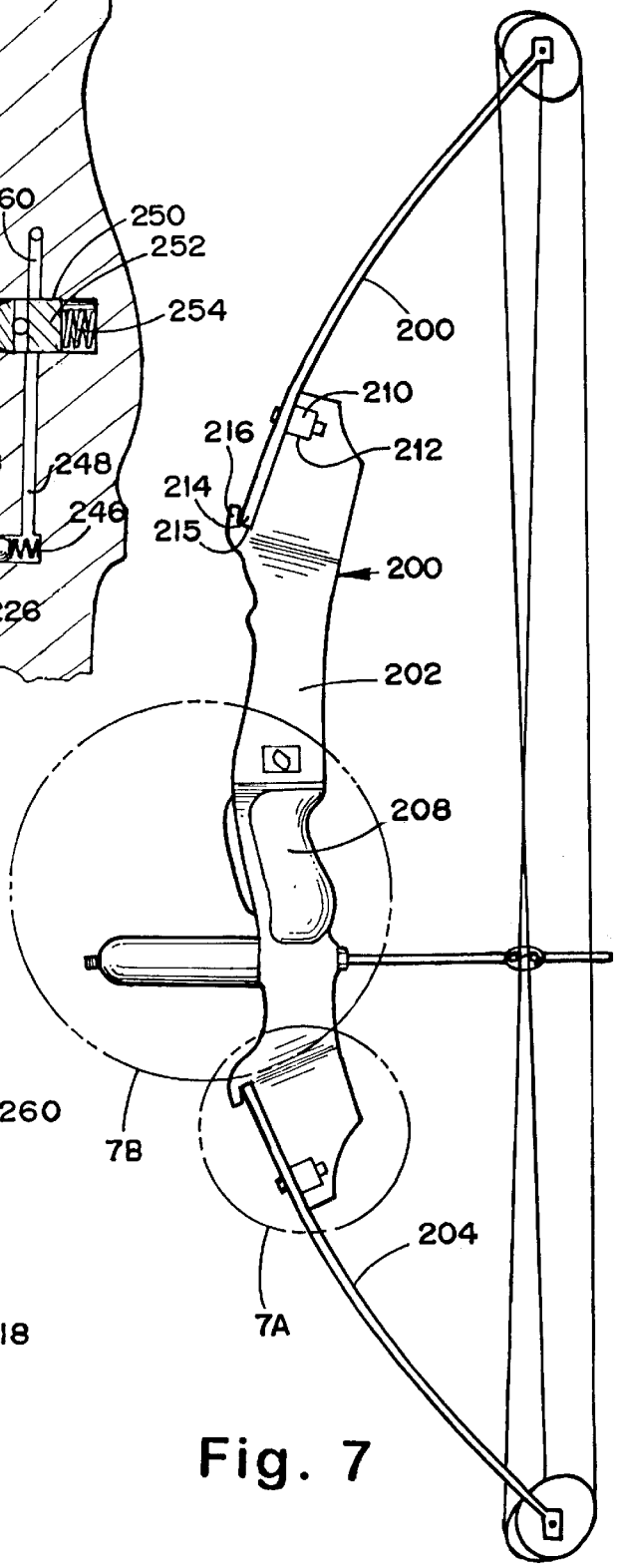
FIG. 7 is a schematic side view of an alternative embodiment of the present invention wherein the clamping mechanism is driven by a pressurized air cylinder and activated by a trigger lever, with the actuating mechanism and slave cylinder being incorporated into the bow as original equipment instead of being added to an existing bow.
Figure 7A:
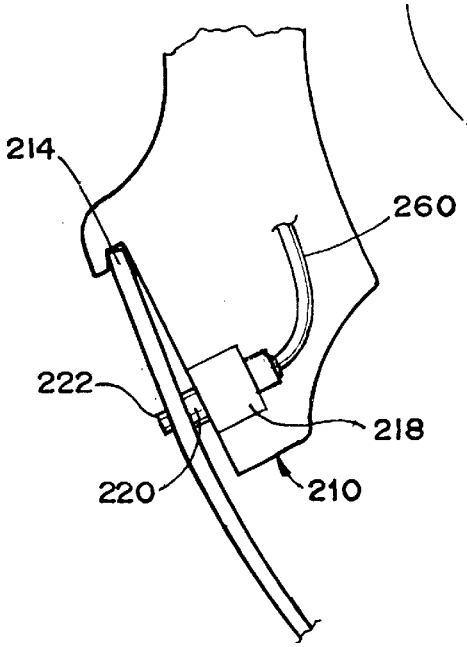
FIG. 7*a* is an exploded cross-sectional view showing the slave cylinder incorporated into the riser of a compound bow.

The foregoing embodiments disclose bow tension relieving devices that can be retrofitted on existing compound bows simply by removing the bolts holding the limbs on the risers and replacing them with slave cylinders and by screwing the pump mechanism into the stabilizer fitting in the riser. It is also possible to incorporate the bow tension relieving device into a bow as original equipment. One embodiment of this type of construction is shown in FIGS. 7, 7*a* and 7*b*. In this embodiment, a bow 200 comprises a riser 202 and limbs 204 mounted on ends of the riser. A bow string 206 is mounted on outer ends of the limbs in a conventional manner. The riser includes a hand grip 208.

In this embodiment, slave cylinders 210 are recessed under the limbs at the ends of the riser in an opening 212 in the riser. End 214 of the limbs fits in a pocket 215 in the riser, with a lip 216 fitting over end 214 of the limb. The pocket and lip serve to hold the end of the limb in place when the limb is deflected by the drawing of the bow string.

As shown in FIGS. 7*a,* slave cylinder 210 includes a body 218 recessed in the riser. A movable piston 220 is movable outwardly from the cylinder so as to contact the underside of the limb. A bolt 222 extends through the limb and slave cylinder and threads into the riser. The slave cylinder is shown in an actuated position in FIG. 7*a* and in a unactuated position in FIG. 7. When the slave cylinder is actuated, the limb is pivoted outwardly from the riser, while the end of the limb is maintained in a fixed position in the riser. This increases the spring force available with the limb. The slave cylinder thus works in the same way as the slave cylinder of the prior embodiment, with the exception that the slave cylinder operates on the opposite side of the pivot point and moves the limb in an opposite direction.

The slave cylinders are actuated by an air pump 224 mounted in the stabilizer opening 226 of the bow by means of a threaded shaft 228 on the pump. The pump includes a cylinder 230 with a piston 232 mounted in a piston chamber 234 inside the cylinder. The piston includes seals 236 that prevent flow around the piston. Hydraulic fluid 238 fills the cylinder on one side of the piston, while pressurized air 240 introduced through valve 242 pressurizes the other side of the piston. The air pressure urges the piston to the right (FIG. 7*b* orientation). When the air moves the piston to the right, hydraulic fluid 238 is forced through an opening 244 in shaft 228. The fluid then goes through a check valve 246 and through a conduit 248 to valve 250. Valve 250 has a valve member 252 reciprocally mounted in the valve. Valve member 252 is biased by spring 254 in a normally closed position. An activation lever 256 pivotally mounted by pin 258 to the front edge of the riser adjacent hand grip 208 engages member 252 and moves the member to an open position when the activation lever is squeezed inwardly toward the riser.

When the valve is actuated, hydraulic fluid passes through internal conduits 260 to the slave cylinders. The conduits are incorporated in closed bores inside the riser and thus are not visible externally.

Valve 242 is a manually openable valve. The valve can be closed and connected with the source of pressurized air in order to pressurize air chamber 240. The valve can be manually unscrewed to release the pressure in the air chamber and thus permit a release in the pressure of the slave cylinders.

To operate the tensioning mechanisms of FIGS. 7, 7*a* and 7*b,* a pressurized air cylinder is screwed into the stabilizer opening in the bow. As the air cylinder is screwed in, the end of the air cylinder engages check valve 246, which opens the air cylinder. When activation lever 256 is pivoted inwardly, fluid pressure is released to the slave valves, bringing the bow to full tension. To release the pressure on the bow, the activation lever is squeezed to close valve 250. Then the valve 242 on the air cylinder is opened to relieve the pressure in the air cylinder and slave valves. For the next shot, the air cylinder is then removed and replaced with a fully pressurized air cylinder. The air cylinders can be pressurized by a pump mechanism separate from the bow and several pressure cylinders can be carried by the archer.

Still another embodiment of a bow tensioning device incorporated as original equipment into a bow is shown in FIGS. 8*a*–8*e*. In this embodiment bow 300 comprises riser 302 and limbs 304, with the limbs having inner ends 306 that are retained in pockets 308 by lips 310 of the riser. This is the same construction as the prior embodiment. Slave cylinders 312 are embedded in the ends of the risers in the manner described previously. A pump 314 of the type shown in FIGS. 2 and 3 is integrally incorporated into the riser. A lever 316 is reciprocated downwardly in order to pressurize the cylinder in the manner shown generally in FIG. 4.

Figure 8C:
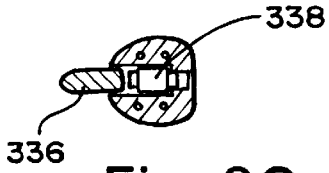
FIG. 8*c* is a cross-sectional view taken along lines 8*c* of FIG. 8.
Figure 8D:
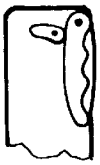
FIG. 8*d* is a side view of the trigger mechanism of FIG. 8*c*.
Figure 8E:
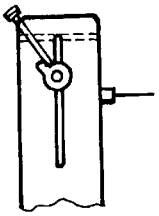
FIG. 8*e* is a front view of the trigger mechanism of FIG. 8*c*.
Figure 8:
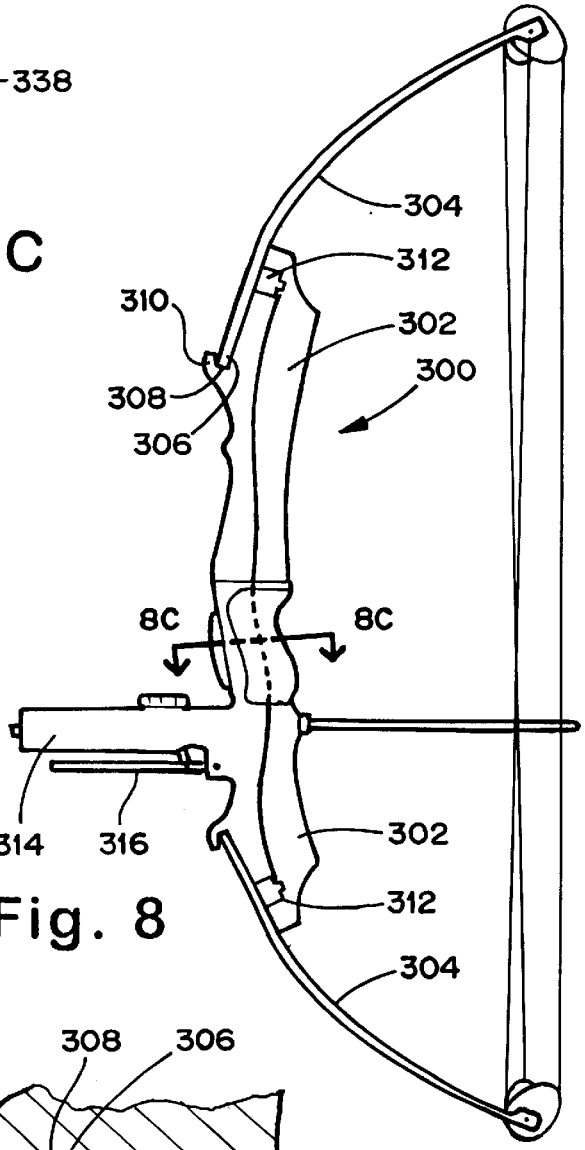
FIG. 8 is a plan view of another embodiment of the present invention, wherein the invention is incorporated into a compound bow as original equipment and a trigger mechanism is incorporated into the riser.
Figure 8B:
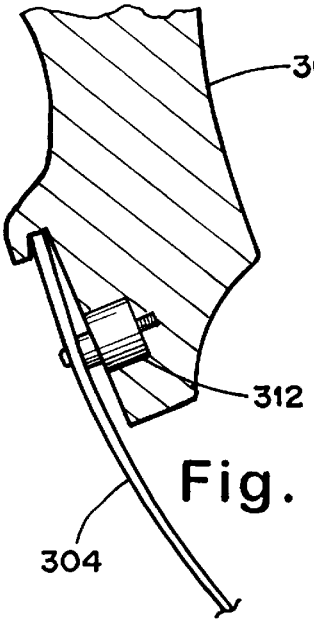
FIG. 8*b* is a fragmentary view showing the slave cylinder attachment mechanism of FIG. 8, with the slave cylinder being in an actuated position.
Figure 8A:
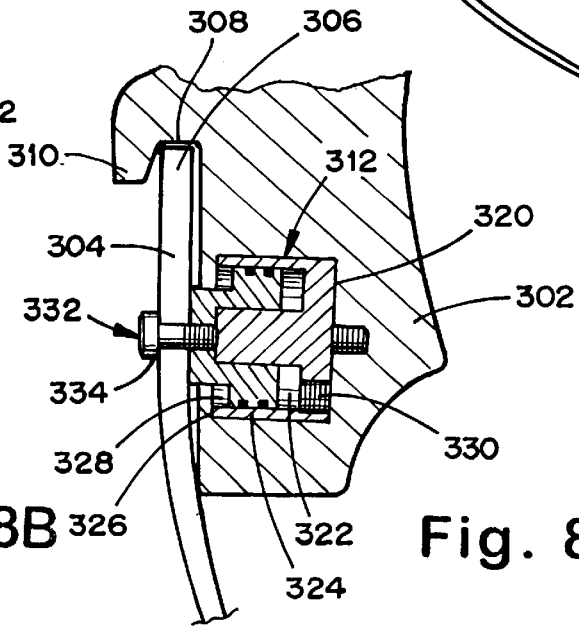
FIG. 8*a* is a cross-sectional view of the slave cylinder of the embodiment of FIG. 8, showing the limb in its relaxed position.

The details of the slave cylinder 312 are shown in FIG. 8*a*. Slave cylinder 312 comprises a fixed position cylinder 320 having an annular pressure chamber 322 therein in which a piston 324 is reciprocally mounted. A ring clip 326 prevents the piston from passing all the way out of an open end 328 of the cylinder. Inlet port 330 is connected to a fluid fitting in the manner described above. A bolt 332 extends through limb 304 and into a bolt opening riser. The piston is pressurized in order to force the piston outwardly against the underside of limb 304. The head 334 on the bolt limits the outward pivotal movement of the limb from the riser.

Trigger mechanisms for actuating the slave cylinders are shown in FIG. 8*c*–8*e*. As shown in FIG. 8*c,* an actuating lever 336 engages a valve member 338 in a normally closed valve. When normally closed, the valve cuts off pressure from the pressure supply to the slave cylinders. When the valve is actuated (which occurs when actuator lever 336 is pulled inwardly) the valve shifts to an open position wherein pressure is supplied to the slave valves.

Figures 9, 9A, 9B:
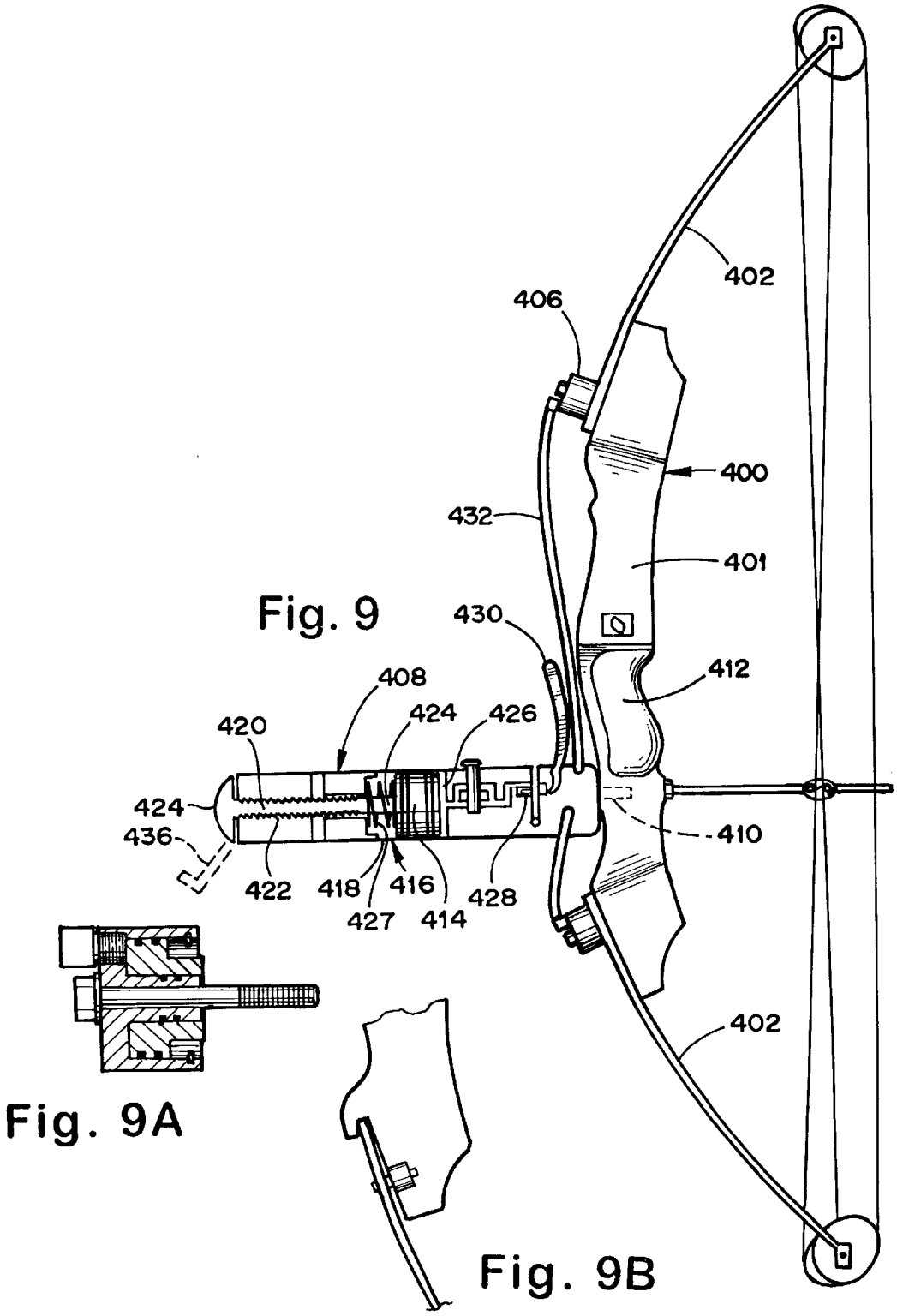
FIG. 9 is another embodiment of the present invention for incorporation in an existing cross bow, wherein a manual pump is different from the pump mechanism of FIG. 2 is employed.
FIG. 9*a* is a cross-sectional view of a slave cylinder used in connection with the embodiment of FIG. 9.
FIG. 9*b* is a cross-sectional fragmentary view showing the incorporation of a slave cylinder in the riser as an alternative to the external slave cylinders shown in FIG. 9.

Another embodiment of the invention designed for use in retrofitting an existing compound bow is shown in FIG. 9. In this figure, bow 400 comprises a riser 401, limbs 402 and bow string 404, all substantially as described above in connection with the embodiments shown in FIGS. 2 and 3. Slave cylinders 406 also are the same as in FIGS. 2 and 3. The difference in this embodiment is a different type of pump 408 is employed. This pump is screwed into the stabilizer fitting 410 in the riser adjacent the bottom side of hand grip 412 as above. Pump 408 (shown in detail in FIG. 10*a*) comprises a piston 414 mounted in a piston chamber 416 in the cylinder 418. A pump shaft 420 is threaded in an opening 422 in a cocking nut 423 on the outside of the cylinder, and an external head 424 on the shaft is positioned outside the cocking nut. A pressure chamber 426 on the right side of the piston is filled with hydraulic fluid. An actuating valve 428 connected to the outlet of pressure chamber 426 can be actuated by pulling a lever 430. When the actuating lever is actuated, pressurized fluid is transmitted through conduits 432 to slave cylinders to clamp the limb tightly to the riser. The conduits may be external as in FIG. 9 or internal as in FIG. 10, in which case the conduits are not visible.

With this embodiment, pressure on the fluid is provided by an air pressure chamber 427 (which includes a spring 429) on the left side of the piston.

The same type of pressure pump is shown in connection with a tensioning device incorporated in a bow as original equipment in FIG. 10. A bow 500 includes riser 502 and limbs 504, with the inner ends 506 of the limbs captured in pockets 508 by lips 510. Slave cylinders 512 are incorporated in the riser in the manner described above. The details of the slave cylinder are shown in FIG. 10*b*.

Figure 10A:
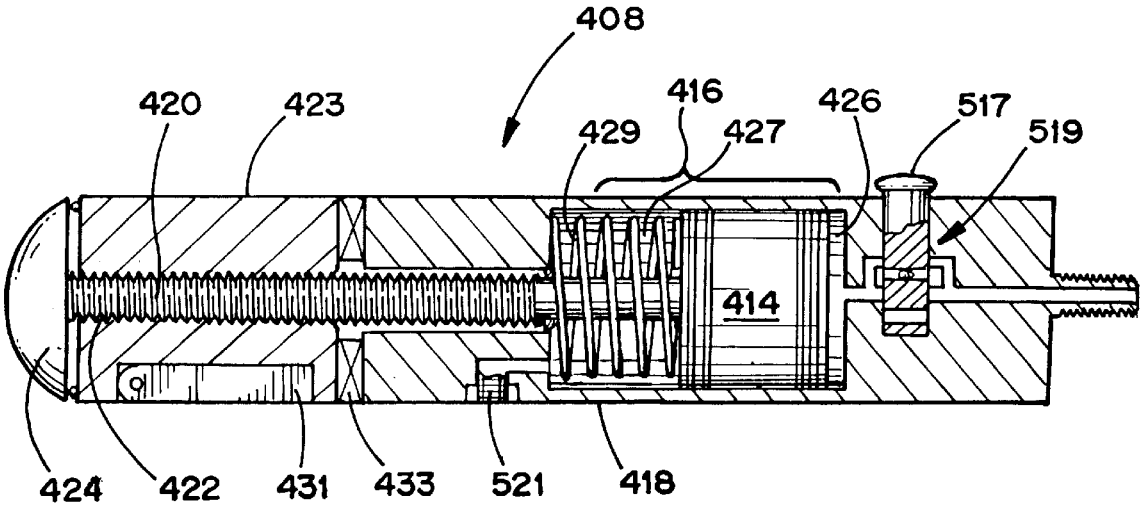
FIG. 10*a* is a cross-sectional view of the cylinder of FIG. 10.

The details of the pressure cylinder are shown in FIG. 10*a*. This device permits the operator to repressurize an air cylinder by means of a cocking nut rotated on the pump mechanism so that a new air cylinder is not necessary each time the pressure is released to release the compression pressure on the slave cylinders.

When one desires to shoot a compound bow or cross bow with this type of pump, the cocking nut 423 is first activated by turning the nut. To activate the cocking nut, a cocking handle 431 (FIG. 10) is first pivoted outwardly from the cocking handle for leverage and then the cocking nut is turned until it stops (about 2½inches). The nut as it is being turned is spinning on a bearing 433 and is screwing the cocking shaft 420 outwardly, causing the piston to compress the air in the air chamber. Before activating the cocking nut, the activating lever or trigger 511 (FIG. 10) is latched back in an activating position, so that passages 515 in a diverter valve 513 are in alignment with the slave cylinder supply lines 525. Then a button 517 on the pump is pushed down, which diverts the supply pressure through a check valve 519 and allows the fluid in the slave cylinders to return to the compression chamber in front of the piston. When the piston is positioned to the left in the compression chamber (FIG. 10*a* orientation), then the trigger or actuation lever is unlatched and the button is pulled upwardly, which will remove the check valve from the fluid circuit. Now, the cocking nut is spun back outwardly to the end of the cocking shaft. An air pressure chamber on the left side of the piston has been prefilled with air at a given pressure through a schrader valve 521. As the cocking shaft is rotated so that it spins outwardly to the end of the cocking shaft, this air pressure, augmented by a spring pressure is applied to the hydraulic fluid on the other side of the piston. When the actuating lever is released, the cocking lever forces fluid under pressure through the conduit lines and to the slave cylinder to actuate the slave cylinder.

Figure 11A:
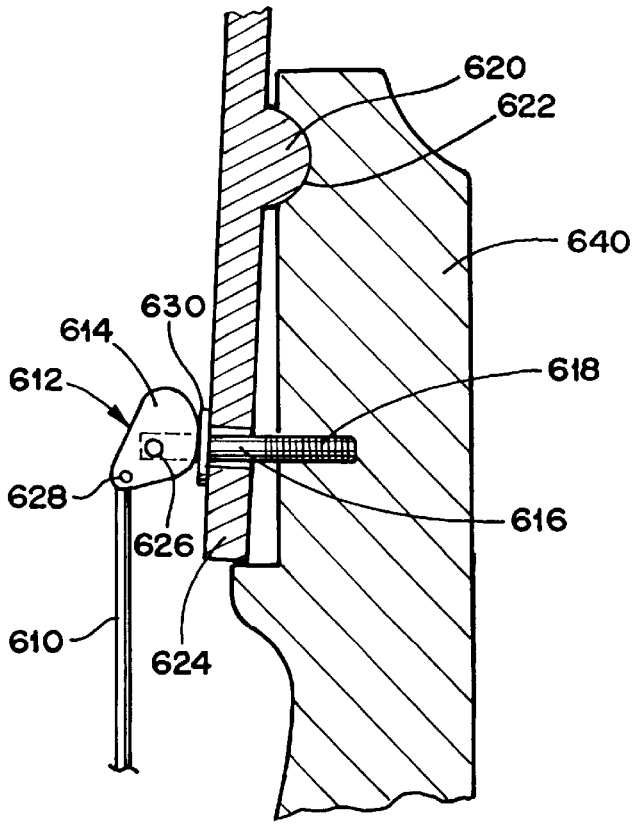
FIGS. 11*a* and 11*b* show the use of a mechanical cam actuating device instead of a slave cylinder, with FIG. 11*a* showing the limb in its relaxed or at rest position and FIG. 11*b* showing the limb in its clamped or activated position.
Figure 11C:
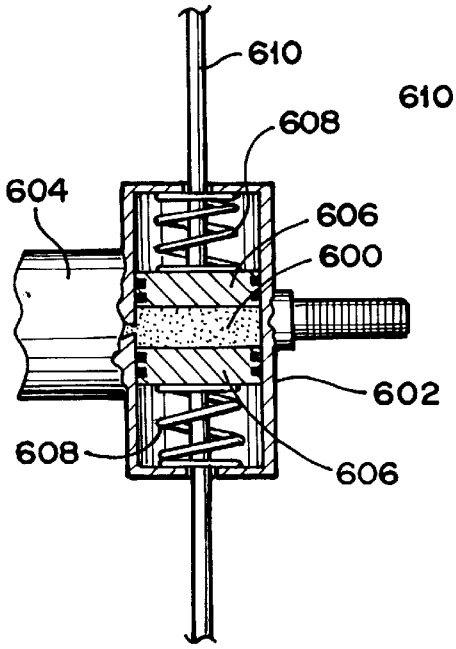
FIG. 11*c* is a schematic view of a slave cylinder connected to the main body of the pump mechanism for translating fluid pressure into mechanical pressure on the cam mechanisms.
Figure 11B:
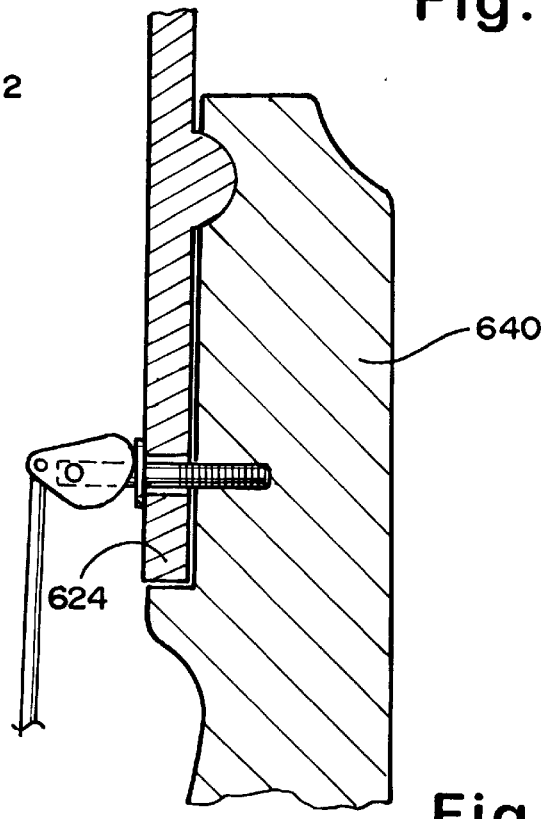

Another embodiment of the invention is shown in FIGS. 11*a*, 11*b* and 11*c*. In this embodiment, the pump mechanism can be of the type used in one of the foregoing embodiments. The difference in this embodiment is that a mechanical actuating device is used instead of slave cylinders.

As shown in FIG. 11*c*, the pump injects hydraulic fluid into a fluid chamber 600 of a slave cylinder 602 from a pump body 604. Pistons 606 mounted on opposite sides of the fluid chamber 600 are biased inwardly by springs 608 and are connected by connecting rods 610 to cams 612 (FIG. 11*a* and 11*b*). When fluid under pressure is injected into chamber 600, this causes pistons to move outwardly and thus rotates the cams from the position shown in FIG. 11*a* to the position shown in FIG. 11*b*. When the pressure is released, the cam returns to its unactuated position shown in FIG. 11*a*.

Referring to FIG. 11*a*, cam mechanism 612 comprises an eccentric cam 614 pivotally mounted on a bolt 616 which is threaded into an opening 618 in the riser. The limb pivots about protrusion 620 which rides in a socket 622 in the riser. The inner end 624 of the limb pivots outwardly in the manner shown in FIG. 11*a* in an at rest or relaxed position and pivots inwardly in the manner shown in FIG. 11*b* to the activated position wherein bow thrust is maximized. The cam is pivotally mounted to threaded shaft 616 by pin 626. The connecting rod is mounted to the cam by pins 628. A washer 630 is interposed between the cam and the limb. As shown in FIGS. 11*a* and 11*b*, when the connecting rod is extended by the injection of the fluid into chamber 600, the cam pivots from the position shown in FIG. 11*a* to the position shown in FIG. 11*b*. This provides a cam force downwardly on the end 624 of the limb and presses the limb downwardly into engagement with the riser 640. Thus, the hydraulic slaver cylinder can be replaced by a mechanical interconnection that performs the same function.

Figure 12A:
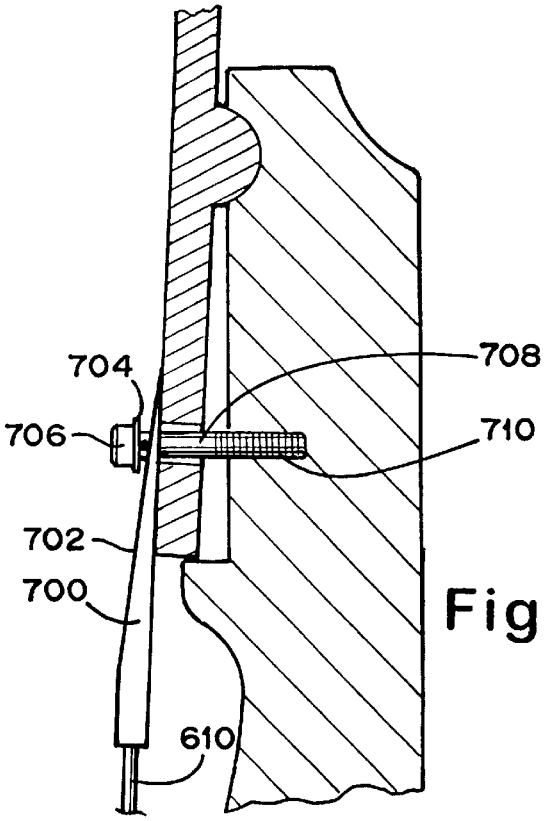
FIG. 12*a* and 12*b* show wedge operated mechanical actuators, with FIG. 12*a* showing the limb in its relaxed or unactuated position and FIG. 12*b* showing the limb in its activated position.
Figure 12C:
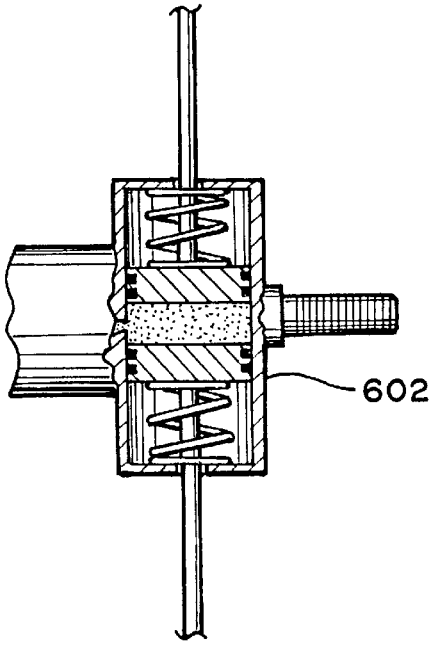
FIG. 12*c* shows a slave cylinder for translating fluid pressure into a mechanical actuating force used to actuate the wedge actuator.
Figure 12B:
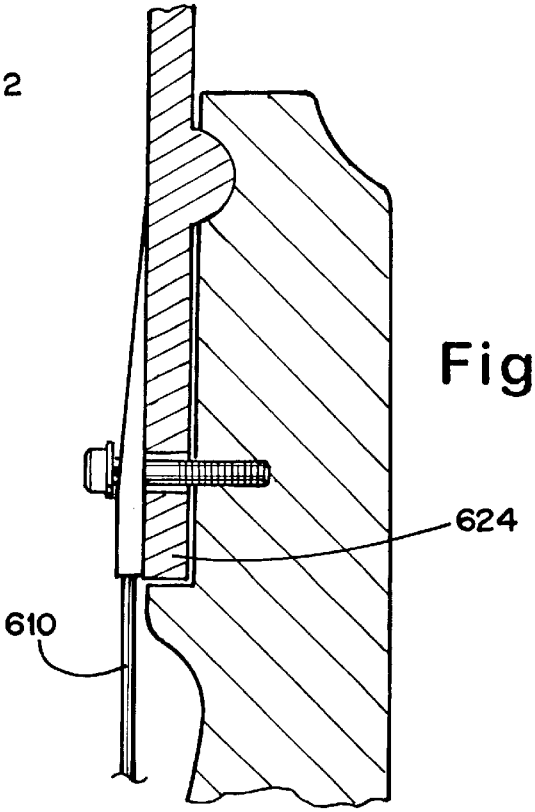

Another mechanical device is shown in FIGS. 12*a*, 12*b* and 12*c*. The slave cylinder employed in this embodiment is the slave cylinder 602 employed in the embodiment of FIG. 11*c*. The difference in this embodiment is that instead of a cam mechanism, a wedge 700 is attached to the end of connecting rod 610, and a beveled surface 702 on the wedge engages a washer 704 on the underside of the head 706 of bolt 708 that extends through the limb and into a threaded opening 710 in the riser.

The action of the wedge is shown in FIGS. 12*a* and 12*b*. In 12*a*, the wedge is retracted and the limb is permitted to pivot outwardly to a relaxed position. In FIG. 12*b*, the wedge is extended, and this presses the end 624 of the limb into engagement with the riser thus activating the bow tensioning device.

Figure 13A:
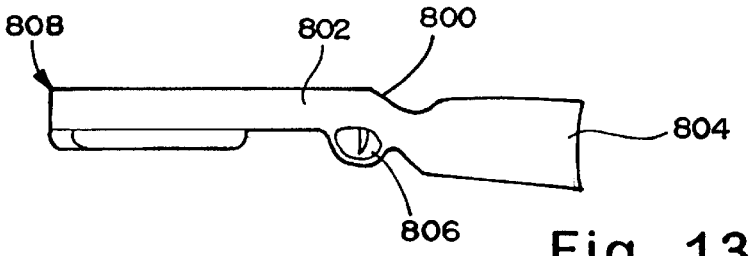
FIG. 13*a* is a cross-sectional view of a cross bow employing a clamping mechanism of the present invention.
Figure 13B:
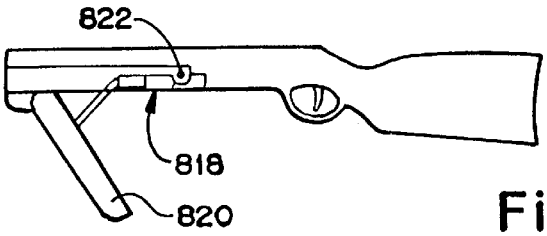
FIG. 13*b* is a view of the cross bow of FIG. 13*a,* showing the pressure pumping lever in its deployed position.
Figure 13D:
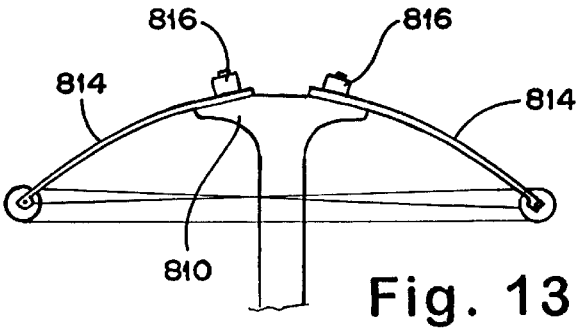
FIG. 13*d* is a plan view of the cross bow of FIG. 13*a,* with the limbs being in an actuated condition.
Figure 13C:
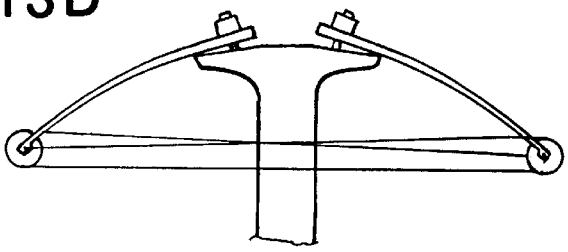
FIG. 13*c* is a plan view showing the cross bow of FIG. 13*a* with the limbs of the cross bow being in a relaxed position.

The application of bow tensioning device to a cross bow is shown in FIG. 13*a*–13*d*. Cross bow 800 comprises a stock 802 having a shoulder engaging portion 804, a trigger 806, and a bow 808 at an outer end of the stock. The outer end of the stock 810 is equivalent to the riser in the compound bow. Limbs 814 are mounted on the riser by means of slave cylinders 816 which replace bolts of the same type used to bolt the limbs to the risers in a compound bow. The construction of the slave cylinders can be of the same type described above. FIG. 13*c* shows the compound bow in a relaxed position wherein the bow string can be drawn, and FIG. 13 shows the bow in an activated position, wherein the slave cylinders have clamped the limbs tightly to the riser portion of the cross bow.

Pressure can be introduced to the slave cylinders by means of a pump 818 mounted in the stock of the cross bow. The pump can be actuated by a lever 820, which operates in a manner similar to the lever operated pumps of FIGS. 2–4. The trigger of the cross bow is the actuating trigger that releases fluid pressure to the slave cylinders. A separate pressure release button 822 can be employed to release pressure from the slave cylinders in the manner of the pressure release mechanism described in connection with FIGS. 2–4.

To operate a cross bow, the pressure is first released so that the limbs are relaxed. Then the bow is pulled back or drawn simply by a hand latch. Then the pump handle is pumped until the pistons are at full stroke. Then the arrow is shot by pulling the trigger. The pressure release button is pressed to release the pressure in the slave cylinders and to relax the limbs of the bow.

It should be understood that the foregoing is merely representative of the preferred practice of the present invention and that various modifications can be made in the embodiments disclosed herein without departing from the spirit and scope of the present invention.

It will be understood by one having ordinary skill in the art and by those who practice the invention, that various modifications and improvements may be made without departing from the spirit of the disclosed concept. Various relational terms, including left, right, front, back, top, and bottom, for example, are used in the claims only to convey relative positioning of various elements of the claimed invention. The scope of protection afforded is to be determined by the claims and by the breadth of interpretation allowed by law.

I claim:

1. In a bow having a riser with opposing first and second riser ends, a first limb connected with the first riser end and extending in a direction that is generally away from the second riser end, and a second limb connected with the second riser end and extending in a direction that is generally away from the first riser end, each of the first and the second limbs having an inner limb end at the riser, the improvement of a tensioning device interconnecting the riser and one of the first and the second limbs, the tensioning device comprising:

a coupling interconnecting the riser and one of the first and the second limbs, the coupling being actuatable between first and second positions, the coupling rotating the one limb a predetermined amount in a first rotational direction to decrease an effort to a predetermined minimal level, of drawing the bow to a shooting position, in the first position, and the coupling rotating the one limb a predetermined amount in a second rotational direction, opposite to the first rotational direction, to increase a shooting force to a predetermined maximum level, in the second position; and an actuator operatively connected with the coupler to actuate the coupler between the first and second positions, the actuator having a bias device that is operatively connected with the coupling and having a trigger that is operatively connected with the bias device, the bias device having a charged state and a released state and being releasable from the charged state to the released state, the coupler being actuated from the first position to the second position when the bias device is released from the charged state to the released state, the trigger being settable by a user to hold the bias device in the charged state and being controllable by a user to release the bias device to the released state.

2. The bow defined in claim 1 further including a second coupling interconnecting the riser and the other of the first and the second limbs, the coupling being actuatable between first and second positions, the coupling rotating the other limb a predetermined amount in a first rotational direction to decrease an effort to a predetermined minimal level, of drawing the bow to a shooting position, in the first position, and the coupling rotating the other limb a predetermined amount in a second rotational direction, opposite to the first rotational direction, to increase a shooting force of the bow to a predetermined maximum level, in the second position.

3. The bow defined in claim 1, wherein the coupling includes one of the group of an extensible cylinder and piston mechanism, a slidable wedge member, and a rotatable cam member.

4. The bow defined in claim 1, wherein the coupling includes an extensible cylinder and piston mechanism, and wherein the bias device includes one of the group of a pneumatic pressure reservoir and a hydraulic pressure reservoir.

5. In a bow having a riser with opposing first and second riser ends, a first limb connected with the first riser end and extending in a direction that is generally away from the second riser end, and a second limb connected with the second riser end and extending in a direction that is generally away from the first riser end, each of the first and the second limbs having an inner limb end at the riser, the improvement of a tensioning device interconnecting the riser and one of the first and the second limbs, the tensioning device comprising:

a coupling interconnecting the riser and one of the first and the second limbs, the coupling being actuatable between first and second positions, the coupling rotating the one limb a predetermined amount in a first rotational direction to decrease an effort to a predetermined minimal level, of drawing the bow to a shooting position, in the first position, and the coupling rotating the one limb a predetermined amount in a second rotational direction, opposite to the first rotational direction, to increase a shooting force to a predetermined maximum level, in the second position, the coupling including a slidable wedge member; and an actuator operatively connected with the coupler to actuate the coupler between the first and second positions the actuator including one of the group of a rod and a cable, which is operatively connected with the wedge member to slide the wedge member between the first and second positions.

6. The bow defined in claim 5, wherein the actuator further includes one of the group of a pneumatic pump and a hydraulic pump, and wherein the actuator further includes an extensible cylinder and piston mechanism operatively connected between the pump and the one of the group of a rod and a cable.

7. In a bow having a riser with opposing first and second riser ends, a first limb connected with the first riser end and extending in a direction that is generally away from the second riser end, and a second limb connected with the second riser end and extending in a direction that is generally away from the first riser end, each of the first and the second limbs having an inner limb end at the riser, the improvement of a tensioning device interconnecting the riser and one of the first and the second limbs, the tensioning device comprising:

a coupling interconnecting the riser and one of the first and the second limbs, the coupling being actuatable between first and second positions, the coupling rotating the one limb a predetermined amount in a first rotational direction to decrease an effort to a predetermined minimal level, of drawing the bow to a shooting position, in the first position, and the coupling rotating the one limb a predetermined amount in a second rotational direction, opposite to the first rotational direction, to increase a shooting force to a predetermined maximum level, in the second position, the coupling including a rotatable cam member; and an actuator operatively connected with the coupler to actuate the coupler between the first and second positions, the actuator including one of the group of a rod and a cable, which is operatively connected with the cam member to rotate the cam member between the first and second positions.

8. The bow defined in claim 7, wherein the actuator further includes one of the group of a pneumatic pump and a hydraulic pump, and wherein the actuator further includes an extensible cylinder and piston mechanism operatively connected between the pump and the one of the group of a rod and a cable.

9. An archery bow comprising:

a riser with a grasping portion, the riser being an elongated member with first and second opposing riser ends;

first and second limbs connected with the riser, the first and second limbs being elongated members having opposing inner and outer ends, the first limb partially overlaying the riser at the first riser end, and extending in a direction that is generally away from the second riser end, the second limb partially overlaying the riser at the second riser end, and extending in a direction that is generally away from the first riser end;

a coupling interconnecting the riser and one of the first and the second limbs near the inner end, the coupling being actuatable between first and second positions, the coupling positioning the inner limb end away from the riser a predetermined distance in the first position, the coupling pressing the inner limb end toward the riser with a predetermined force in the second position; and an actuator operatively connected with the coupler to actuate the coupler between the first and second positions, the actuator having a bias device that is operatively connected with the coupling and having a trigger that is operatively connected with the bias device, the bias device having a charged state and a released state and being releasable from the charged state to the released state, the coupler being actuated from the first position to the second position when the bias device is released from the charged state to the released state, the trigger being settable by a user to hold the bias device in the charged state and being controllable by a user to release the bias device to the released state.

10. The bow defined in claim 9 further including a second coupling interconnecting the riser and the other of the first and the second limbs near the inner end, the second coupling being actuatable between first and second positions, the coupling positioning the inner limb end away from the riser a predetermined distance in the first position, the coupling pressing the inner limb end toward the riser with a predetermined force in the second position, and the coupling being operatively connected with the actuator.

11. The bow defined in claim 9, wherein the coupling includes one of the group of an extensible cylinder and piston mechanism, a slidable wedge member, and a rotatable cam member.

12. The bow defined in claim 9, wherein the coupling includes an extensible cylinder and piston mechanism, and wherein the bias device includes one of the group of a pneumatic pressure reservoir and a hydraulic pressure reservoir.

13. An archery bow comprising:

a riser with a grasping portion, the riser being an elongated member with first and second opposing riser ends;

first and second limbs connected with the riser, the first and second limbs being elongated members having opposing inner and outer ends, the first limb partially overlaying the riser at the first riser end, and extending in a direction that is generally away from the second riser end, the second limb partially overlaying the riser at the second riser end, and extending in a direction that is generally away from the first riser end;

a coupling interconnecting the riser and one of the first and the second limbs near the inner end, the coupling being actuatable between first and second positions, the coupling positioning the inner limb end away from the riser a predetermined distance in the first position, the coupling pressing the inner limb end toward the riser with a predetermined force in the second position, the coupling including a slidable wedge member; and an actuator operatively connected with the coupler to actuate the coupler between the first and second positions, the actuator including one of the group of a rod and a cable, which is operatively connected with the wedge member to slide the wedge member between the first and second positions.

14. An archery bow comprising:

a riser with a grasping portion, the riser being an elongated member with first and second opposing riser ends;

first and second limbs connected with the riser, the first and second limbs being elongated members having opposing inner and outer ends, the first limb partially overlaying the riser at the first riser end, and extending in a direction that is generally away from the second riser end, the second limb partially overlaying the riser at the second riser end, and extending in a direction that is generally away from the first riser end;

a coupling interconnecting the riser and one of the first and the second limbs near the inner end, the coupling being actuatable between first and second positions, the coupling positioning the inner limb end away from the riser a predetermined distance in the first position, the coupling pressing the inner limb end toward the riser with a predetermined force in the second position, the coupling including, a rotatable cam member; and an actuator operatively connected with the coupler to actuate the coupler between the first and second positions, the actuator including one of the group of a rod and a cable, which is operatively connected with the cam member to rotate the cam member between the first and second positions.

15. An archery bow comprising:

a riser with a grasping portion, the riser being an elongated member with first and second opposing riser ends;

first and second limbs connected with the riser, the first and second limbs being elongated members having opposing inner and outer ends, the first limb partially overlaying the riser at the first riser end, and extending in a direction that is generally away from the second riser end, the second limb partially overlaying the riser at the second riser end, and extending in a direction that is generally away from the first riser end;

a coupling interconnecting the riser and one of the first and the second limbs near the corresponding one of the first and the second riser ends, the coupling being actuatable between first and second positions, the coupling positioning the one limb away from the one riser end a predetermined distance in the first position, the coupling pressing the one limb toward the one riser end with a predetermined force in the second position; and an actuator operatively connected with the coupler to actuate the coupler between the first and second positions, the actuator having a bias device that is operatively connected with the coupling and having a trigger that is operatively connected with the bias device, the bias device having a charged state and a released state and being releasable from the charged state to the released state, the coupler being actuated from the first position to the second position when the bias device is released from the charged state to the released state, the trigger being settable by a user to hold the bias device in the charged state and being controllable by a user to release the bias device to the released state.

16. The bow defined in claim 15 further including a second coupling interconnecting the riser and the other of the first and the second limbs near the corresponding other one of the first and the second riser ends, the second coupling being actuatable between first and second positions, the coupling positioning the other limb away from the other riser end a predetermined distance in the first position, the coupling pressing the other limb toward the other riser end with a predetermined force in the second position, and the coupling being operatively connected with the actuator.

17. The bow defined in claim 15, wherein the coupling includes one of the group of an extensible cylinder and piston mechanism, a slidable wedge member, and a rotatable cam member.

18. The bow defined in claim 15, wherein the coupling includes an extensible cylinder and piston mechanism, and wherein the bias device includes one of the group of a pneumatic pressure reservoir and a hydraulic pressure reservoir.

19. An archery bow comprising:

a riser with a grasping portion, the riser being an elongated member with first and second opposing riser ends;

first and second limbs connected with the riser, the first and second limbs being elongated members having opposing inner and outer ends, the first limb partially overlaying the riser at the first riser end, and extending in a direction that is generally away from the second riser end, the second limb partially overlaying the riser at the second riser end, and extending in a direction that is generally away from the first riser end;

a coupling interconnecting the riser and one of the first and the second limbs near the corresponding one of the first and the second riser ends, the coupling being actuatable between first and second positions, the coupling positioning the one limb away from the one riser end a predetermined distance in the first position, the coupling pressing the one limb toward the one riser end with a predetermined force in the second position, the coupling including a slidable wedge member; and an actuator operatively connected with the coupler to actuate the coupler between the first and second positions, the actuator including one of the group of a rod and a cable, which is operatively connected with the wedge member to slide the wedge member between the first and second positions.

20. An archery bow comprising:

a riser with a grasping portion, the riser being an elongated member with first and second opposing riser ends;

first and second limbs connected with the riser, the first and second limbs being elongated members having opposing inner and outer ends, the first limb partially overlaying the riser at the first riser end, and extending in a direction that is generally away from the second riser end, the second limb partially overlaying the riser at the second riser end, and extending in a direction that is generally away from the first riser end;

a coupling interconnecting the riser and one of the first and the second limbs near the corresponding one of the first and the second riser ends, the coupling being actuatable between first and second positions, the coupling positioning the one limb away from the one riser end a predetermined distance in the first position, the coupling pressing the one limb toward the one riser end with a predetermined force in the second position, the coupling including a rotatable cam member; and an actuator operatively connected with the coupler to actuate the coupler between the first and second positions, the actuator including one of the group of a rod and a cable, which is operatively connected with the cam member to rotate the cam member between the first and second positions.

* * * * *